US011944861B1

(12) United States Patent
Goldberg

(10) Patent No.: US 11,944,861 B1
(45) Date of Patent: Apr. 2, 2024

(54) EXERCISE DEVICE WITH VERTICALLY ADJUSTABLE EXERCISE ARM

(71) Applicant: Serge Goldberg, Ambler, PA (US)

(72) Inventor: Serge Goldberg, Ambler, PA (US)

( * ) Notice: Subject to any disclaimer, the term of this patent is extended or adjusted under 35 U.S.C. 154(b) by 0 days.

(21) Appl. No.: 18/373,478

(22) Filed: Sep. 27, 2023

(51) Int. Cl.
*A63B 21/06* (2006.01)
*A63B 21/00* (2006.01)

(52) U.S. Cl.
CPC ..... *A63B 21/0615* (2013.01); *A63B 21/159* (2013.01); *A63B 21/4035* (2015.10); *A63B 2225/093* (2013.01)

(58) Field of Classification Search
CPC ..... A63B 21/0615; A63B 21/159; A63B 21/4035; A63B 2225/093
See application file for complete search history.

(56) References Cited

U.S. PATENT DOCUMENTS 2,855,199 A * 10/1958 Noland ..... A63B 21/4047 601/24
7,641,602 B2 * 1/2010 Rogers ..... A63B 21/08 482/135
10,646,744 B2 * 5/2020 Steenekamp ..... A63B 21/156
11,458,349 B1 * 10/2022 Carlson ..... A63B 21/4035
11,712,597 B2 * 8/2023 Carlson ..... A63B 17/02 482/94
2017/0319905 A1 * 11/2017 O'Connor ..... A63B 21/00181
2019/0269963 A1 * 9/2019 Steenekamp ..... A63B 23/1254
2023/0081926 A1 * 3/2023 Chang ..... A63B 21/0617 482/97
2023/0087315 A1 * 3/2023 Murdock ..... A63B 21/4035 482/94
2023/0123978 A1 * 4/2023 Carlson ..... A63B 21/08 482/94
2023/0302321 A1 * 9/2023 Dunbar ..... A63B 23/1245

* cited by examiner

*Primary Examiner* — Joshua Lee
(74) *Attorney, Agent, or Firm* — Caesar Rivise, PC

(57) ABSTRACT

An exercise device includes an elongate support member having opposed ends and being rotatably mounted through either directly to—or through an attachment member to a mounting member intermediate the opposed ends of the elongate support member. A horizontally extending axle is rotatably mounted to the elongate support member adjacent one the opposed ends. The horizontally extending axle is connected to a weight support and to an exercise arm. The elongate support member is grippable to permit its rotation about its rotatable mount to change the vertical position of the horizontally extending axle and the weight support and exercise arm connected thereto. An attachment member configured be connected to the mounting member in a desired location also constitutes a part of the invention.

18 Claims, 8 Drawing Sheets

EXERCISE DEVICE WITH VERTICALLY ADJUSTABLE EXERCISE ARM

BACKGROUND OF THE INVENTION

1. Field of Invention

This invention relates to an exercise device and more specifically to an exercise device providing easy adjustment to permit both pushing and pulling exercises.

2. Description of Related Art

Exercise devices employing vertically adjustable mounts for exercise arms or other gripping members are known, to allow individuals to conduct both pushing exercises and pulling exercises with the same device. However, these prior art devices are believed to have various deficiencies. First, the vertically adjustable members in various exercise devices are heavy, difficult or cumbersome to use. Second, a number of exercise devices with vertically adjustable members are not easily adapted to be connected to existing cages or support members presently being used to support various exercise devices. Third, a number of exercise devices employing vertically adjustable members also employ complex pulley systems or other complex arrangements to provide adjustability.

A need exists for an exercise device include an easily and reliable arrangement for changing the vertical position of a rotatable exercise arm to be engaged by an individual, to permit the individual to carry out downward pushing and upward pulling exercises when said exercise arm is in one vertical position and to engage in downward pulling and upward pushing exercises with the exercise arm moved to another, higher vertical position. In addition, a need exists for an exercise device including a vertically adjustable exercise arm that can be set up for use by being connected to frame members of existing cage constructions; either directly or through a connecting member connectable to such frame members at a desired height or location. In addition, applicant believes that a need exists for an exercise device that avoids the use of a complex pulley system.

The most preferred embodiment of the present invention overcomes the deficiencies of prior art exercise devices employing vertically adjustable exercise arms or gripping members.

SUMMARY OF THE INVENTION

An exercise device in accordance with this invention includes an elongate support member terminating at opposed ends and being rotatably mounted through a rotatable mount to a mounting member intermediate said opposed ends of said elongate support member. The mounting member can be any type of support or frame, including but not limited to a frame member of an existing cage employed to support various exercise devices. Cages employed to support exercise devices are well known to those skilled in the art.

Reference throughout this application to the elongate member being rotatably mounted "to (or "on") a mounting member" or "to (or "on") a frame member" includes both a direct connection to said members or an indirect connection to said members through a separate attachment member.

A horizontally extending axle is rotatably mounted to the elongate support member adjacent one of the opposed ends of said elongate support member, The horizontally extending axle is connected to a weight support on one side of the rotatably mounted elongate support member and is connected to an exercise arm on an opposite side of the rotatably mounted elongate support member. The weight support can be of any desired configuration, provided that it is connected to the horizontally extended axle and is capable of receiving one or more weights to provide a resisting force to the rotational movement of the exercise arm during a pulling or pushing exercise of an individual.

The elongate support member is grippable to be rotated about its rotatable mount to change the vertical position of the horizontally extending axle, the weight support and the exercise arm; preferably between two vertical positions. In a low vertical position of the horizontally extending axle an individual easily can engage the exercise arm to provide downward pushing or upward pulling exercises; the lower vertical position being below the shoulders of the individual when said individual is in a standing position. In a high vertical position, the horizontally extending axle is above the shoulders of an individual conducting an exercise when the individual is in a standing position; allowing the individual to engage in downward pulling or upward pushing exercises through the exercise arms.

In a preferred embodiment the exercise device includes a first locking member connected to the horizontally extending axle adjacent the exercise arm to rotate with the horizontally extending axle. The exercise arm has a second locking member configured to be engaged and disengaged from the first locking member to permit the exercise arm, when the locking members are disengaged, to be rotated about the horizontally extending axle to position the exercise arm in a desired orientation for engagement by an individual using the device. When the exercise arm is in a desired orientation the locking members are engaged and rotational movement of the exercise arm rotates the horizontally extending axle and the weight support connected thereto. The weight support can include one or more weights, e.g., free weights, to provide a desire resistance to the pushing/pulling force imparted to the exercise arm.

In the most preferred embodiment of this invention, the first locking member identified in the preceding paragraph includes a plurality of arcuately spaced openings therein and the second locking member that is attached to the exercise arm is configured to be engaged in- and disengaged from the arcuately spaced openings of the first locking member. For example, the second locking member can be in the form of a spring-loaded pin normally biased to engage within a desire opening of the first locking member. This arrangement permits the exercise arm to be rotated relative to the horizontally extending axle, when the locking members are disengaged, to position the exercise arm in a desire orientation for the individual using the device, and then to engage the locking members to permit rotation motion of the exercise arm to be transmitted to the horizontally extending axle and to the weight support, which can include a desired amount of weight thereon.

In the most preferred embodiments of this invention the exercise device is free of pulleys.

In the preferred embodiment of this invention the elongate support member to which the horizontally extending axle is rotatable mounted includes a defined gripping section/member spaced from the rotatable mount of the elongate support member adjacent an end of the rotatable mount opposite the end to which the axle is rotatably mounted. This permits easy rotation of the elongate support member about its rotatable mount to thereby provide easy vertical adjustment of the horizontally extending axle and the members connected thereto; preferably between upper and lower positions in which the exercise device is to be used. A retaining member is provided to retain the elongate support member in either the upper or lower positions in which an individual is employing the exercise device.

BRIEF DESCRIPTION OF THE SEVERAL VIEWS OF THE DRAWINGS

The invention will be described in conjunction with the following drawings in which like reference numerals designate like elements and wherein.

DETAILED DESCRIPTION OF THE INVENTION

Figure 1:
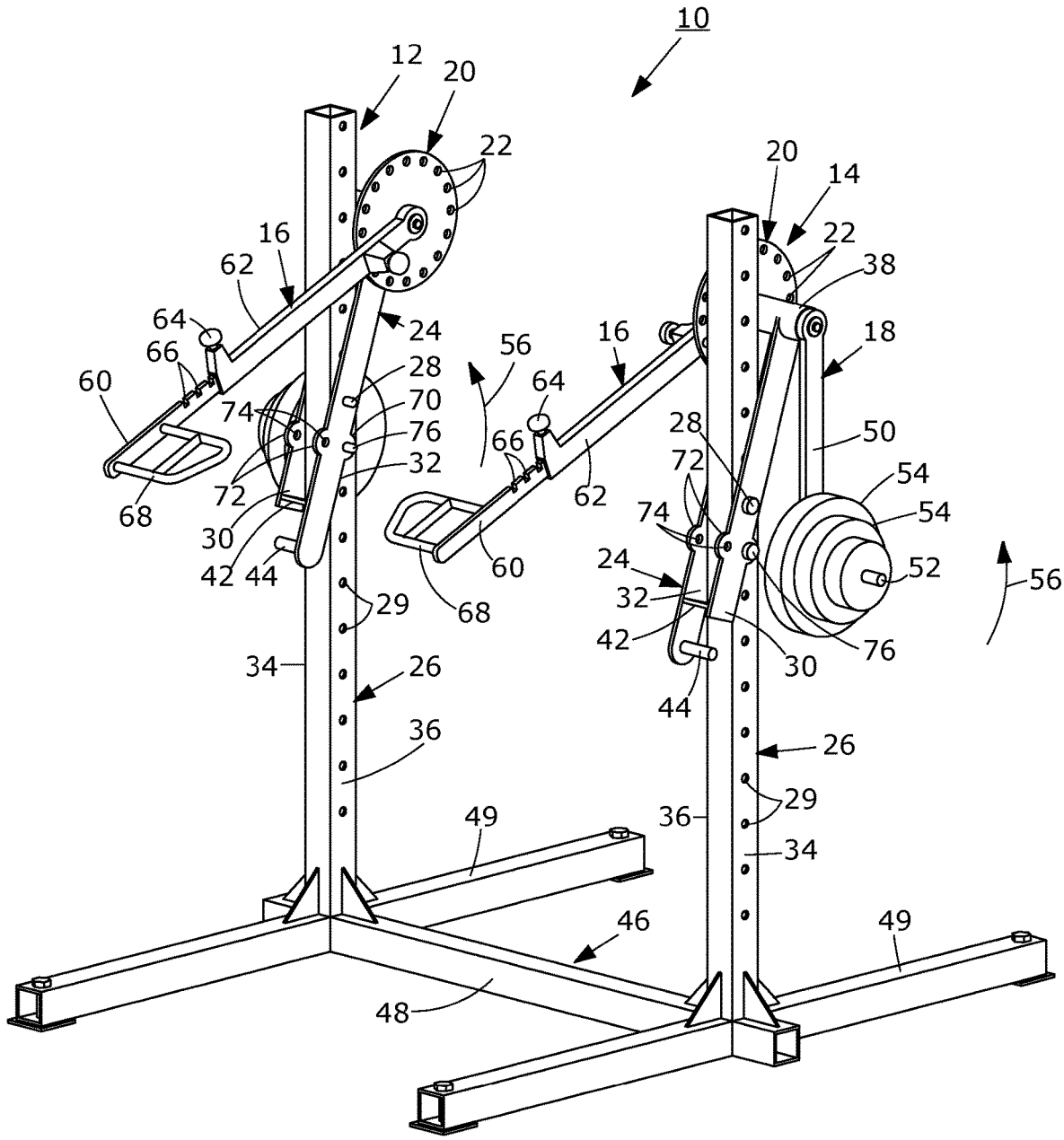
FIG. 1 is an isometric view of an exercise device of this invention showing rotational axles of the exercise arms in an upper position.
Figure 2:
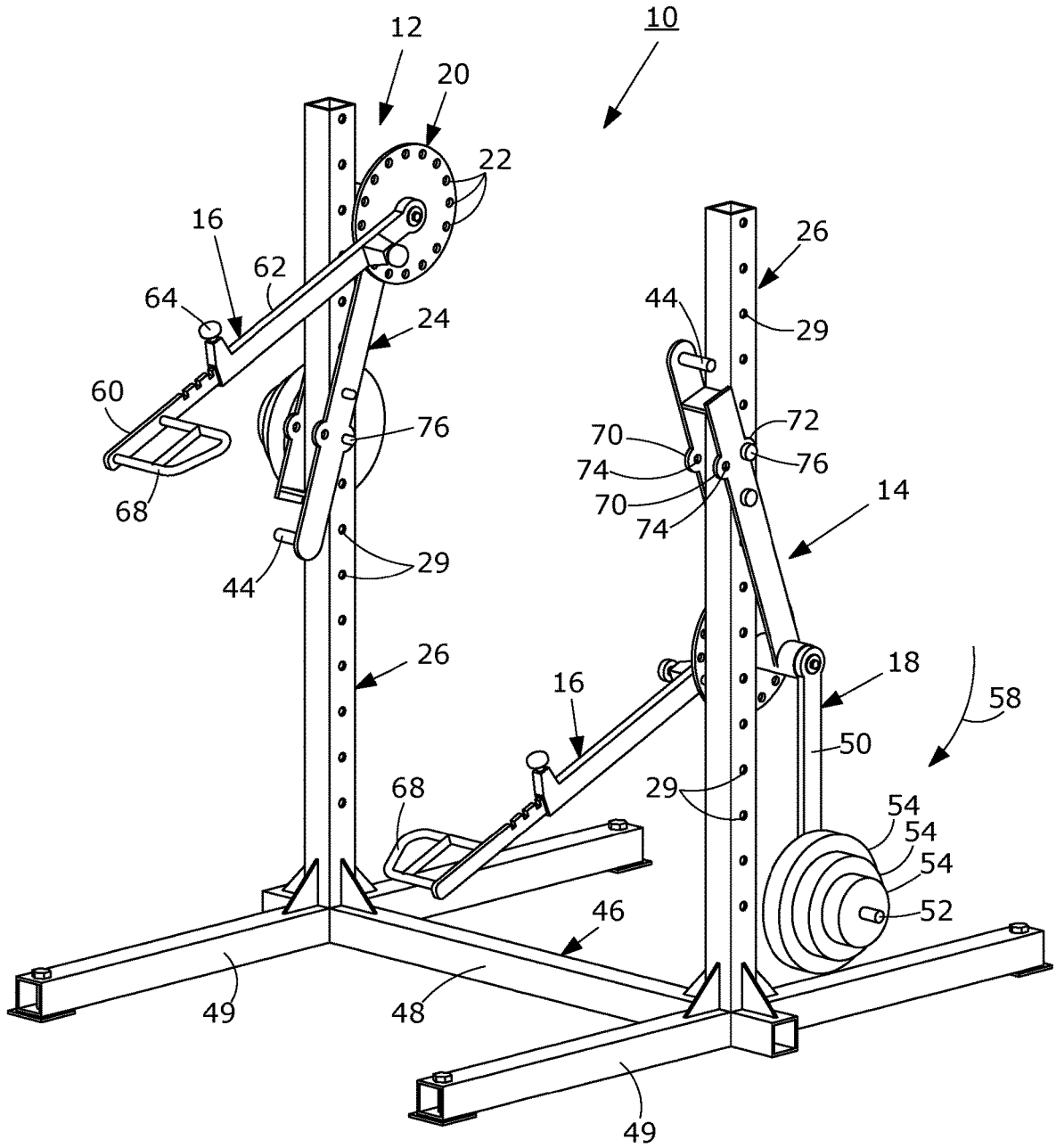
FIG. 2 is a view similar to FIG. 1 but showing a rotational axle of one of the exercise arms in an upper position and the rotational axle of the other of said exercise arms in lower position.

Referring to FIGS. 1 and 2, an exercise device 10 of this invention includes transversely spaced-apart arm assemblies 12 and 14. The arm assemblies 12, 14 preferably being of identical constructions, each including an exercise arm 16 connected to a weight supporting member 18 to rotate relative to said weight supporting member when unlocked. A locking member 20 in the form of an annular disc includes multiple openings 22 therein arranged in a circular array. The exercise arm 16 can be locked to said locking member 20 in multiple rotational positions, as will be described in detail hereinafter.

Figure 5:
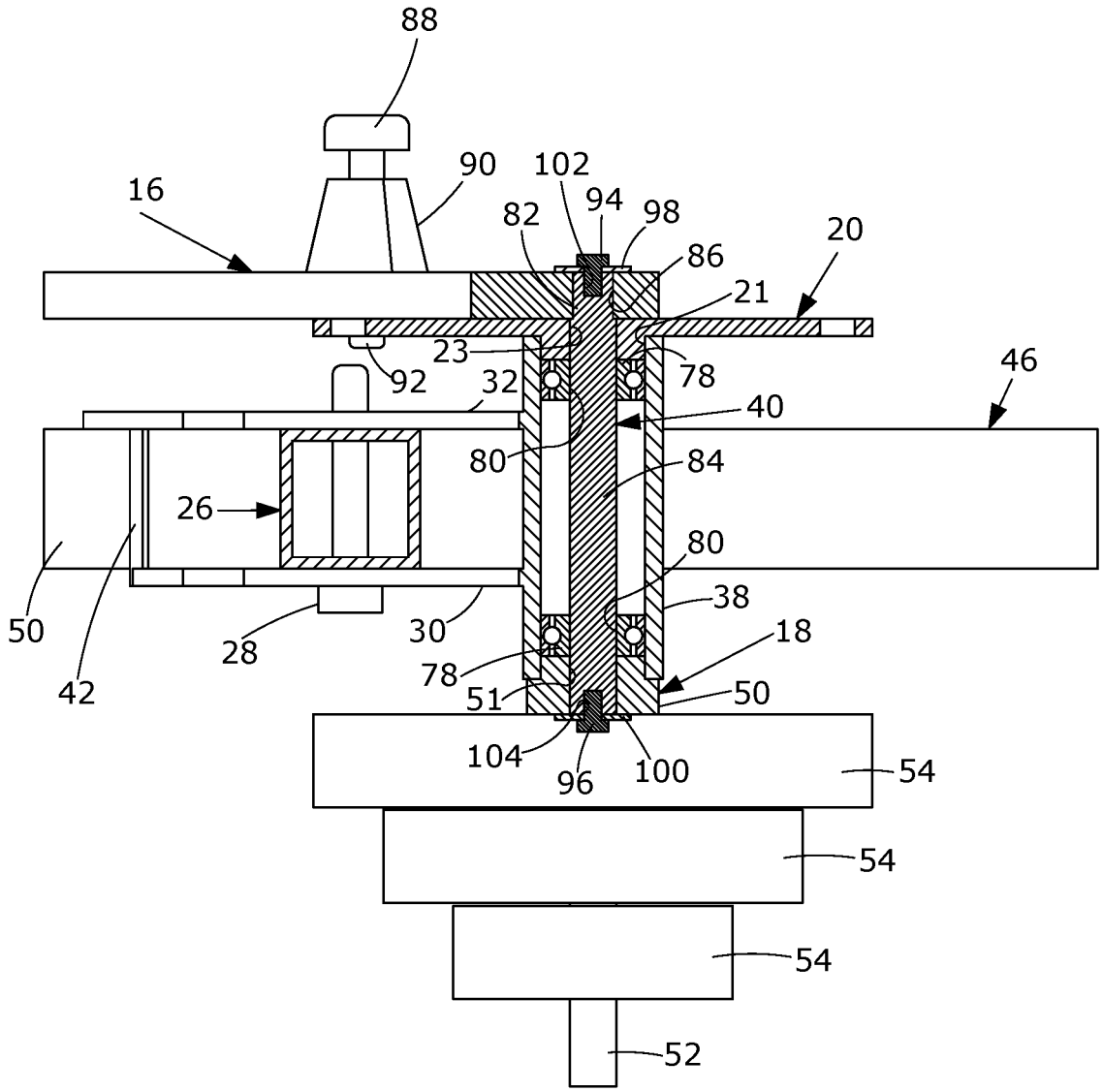
FIG. 5 is a sectional view taken through 5-5 of FIG. 4.
Figure 6:
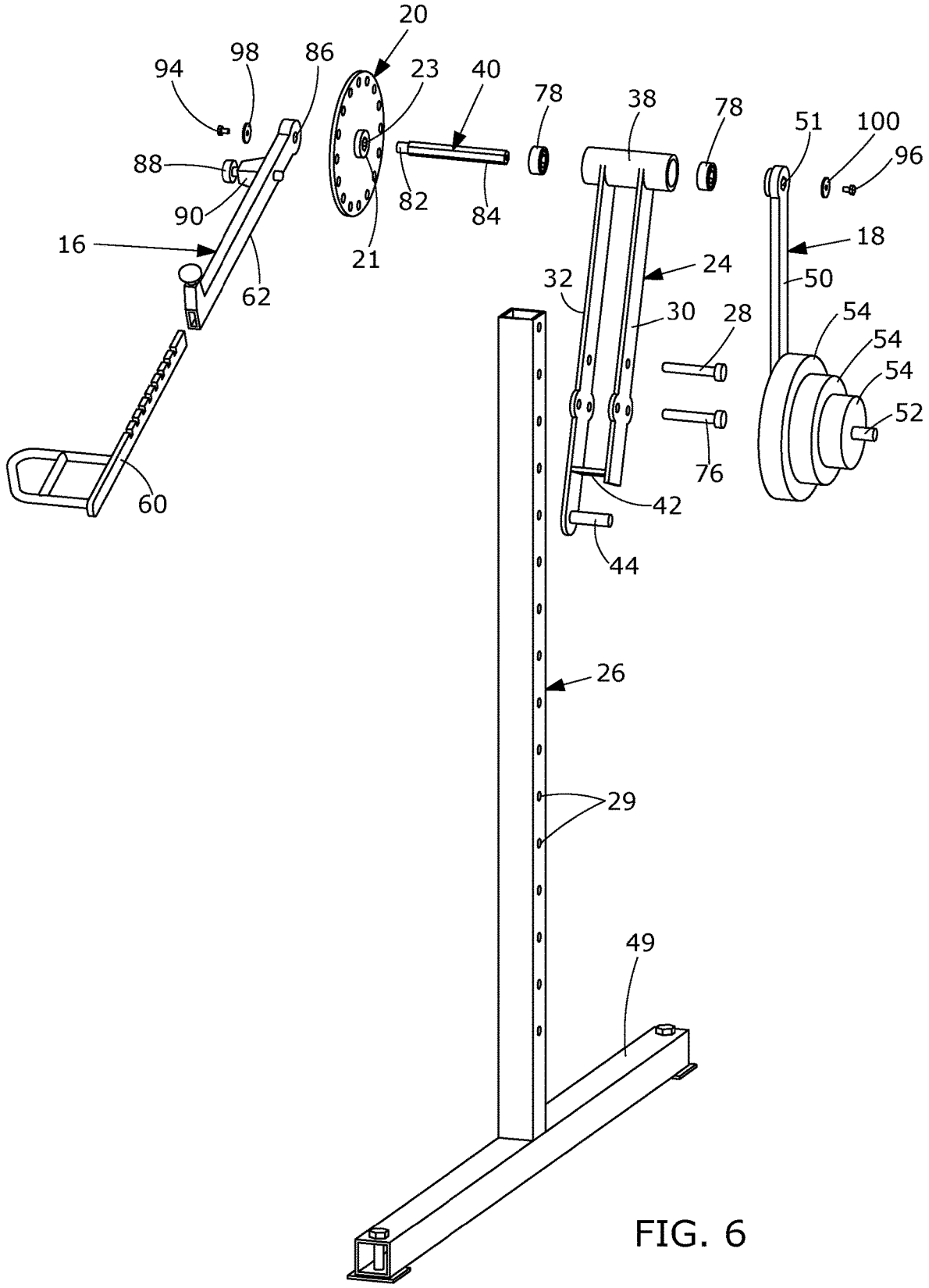
FIG. 6 is an exploded isometric view of the elements of the right arm assembly shown in FIG. 1.

Referring to FIGS. 5 and 6, locking member 20 is connected to the weight supporting member 18 through an axle 40 to rotate with said weight supporting member in a manner to be described in detail hereinafter. The exercise arm 16 rotates the weight supporting member 18 when said exercise arm is locked to locking member 20 and rotated during exercising.

Referring to FIGS. 1 and 2, an elongate member 24 is rotationally retained to a mounting member in the form of a vertical frame member 26 through an axle 28 intermediate first and second opposed ends of said elongate member. In one preferred embodiment of this invention, the vertical frame member 26 is square in cross-section, and the elongate member 24 includes transversely spaced-apart elongate sections 30, 32 located adjacent opposed, outer and inner walls 34, 36 of the vertical frame member. The elongate sections 30, 32 are rotatably mounted intermediate their ends on axle 28 passing through a desired set of diametrically opposed openings 29 in outer and inner walls 34, 36, respectively, of the vertical frame member 26. Forming elongate member 24 of the transversely spaced-apart elongate sections 30, 32 provides an extremely stable and rugged construction, and therefore is a preferred construction in exercise machine 10. However, within the broadest aspects of this invention the elongate member may have other configurations; provided that they are sufficiently rigid to permit effective use of the exercise device 10.

The vertical frame members 26 having vertically spaced apart openings 29 therein are commonly employed as part of existing cage constructions designed to retain several types of exercise devices. The exercise device 10 of the present invention is well-suited for installation on vertical frame members of such existing cages. Alternatively, the exercise device 10 of this invention can be retained on vertical frame members that are independent of any cage construction, as is shown at 26 in FIGS. 1 and 2.

As can be seen in FIGS. 1, 2, 5 and 6 the spaced apart elongate sections 30, 32 of elongate member 24 are interconnected adjacent one end by an annular member 38 for rotatably receiving an axle 40 therein. As will be explained in greater detail hereinafter, the locking member 20 and the weight supporting member 18 are secured to axle 40 to rotate therewith. Therefore, when the exercise arm 16 is rotated to a desired position and connected to locking member 20, rotation of the exercise arm by an individual also rotates the weight supporting member 18, as will be explained in greater detail hereinafter.

Still referring to FIGS. 1, 2, 5 and 6 the ends of elongate sections 30, 32 opposed to the ends interconnected by annular member 38, and on the opposite side of axle 28 are interconnected by a plate 42, or other suitable connector welded thereto. In this construction, the elongate sections 30, 32 are inserted over the top of a desired vertical frame member 26 for rotatable connection through a desired set of openings 29 in said frame member. In an alternative arrangement, in place of plate 42 a spacer member can be removably attached to the ends of the elongate sections 30, 32 opposed to the ends interconnected by annular member 38 after the elongate sections 30, 32 are placed on opposed sides of a corresponding vertical frame member 26 and rotatably connected to said frame member. This latter arrangement is preferred since it permits the elongate sections 30, 32 of elongate member 24 to be inserted adjacent the opposed sides of the vertical frame member 26 without having to be inserted over the top of said vertical frame member.

Still referring to FIGS. 1, 2, 5 and 6 an end of elongate section 32 extends beyond the plate 42 (or removable spacer member) and includes a transversely extending member 44 of any desired construction or design to be gripped by an individual to rotate elongate member 24 about axle 28 and thereby change the vertical position of the rotational axle 40 and the exercise arm 16, locking member 20 and weight supporting member 18 connected to said rotational axle. The weight supporting member 18 of each spaced-apart arm assembly 12, 14 is adjacent an outer side 34 of a respective vertical frame member 26 and the exercise arm 16 and adjacent locking member 20 of each spaced-apart arm assembly 12, 14 are adjacent an inner side 36 of a respective vertical frame member 26.

Referring to FIG. 1, a representative lower support 46 of the exercise device 10 is H-shaped, including a transversely extending frame member 48 bridging outer frame members 49 intermediate the ends of such outer frame members. The vertical frame members 26 are each supported/mounted on a respective outer frame member 49 and transversely extending frame member 48 at the junction of said outer frame member and transversely extending frame member. In the disclosed embodiment, the outer frame members 49 are of a sufficient length to prevent the exercise device 10 from tipping over during use, without the need to bolt or otherwise fasten the lower support 46 to the ground or other supporting surface. The specific support for the exercise device 10 disclosed herein is not a limitation on the broadest aspects of this invention. For example, the support for the exercise device 10 can be vertical frame members of an existing cage construction.

As can be seen best in FIGS. 1, 2, 5 and 6, each of the weight support members 18 includes a downwardly extending arm 50 and a transverse extension 52 at a lower distal end of said arm for receiving and supporting one or more weights 54 thereon. In a normal position, prior to an exercise being conducted, the downwardly extending arm 50 of each of the weight supporting members 18 is biased into a generally vertical position. Thus, each of the weight supporting members 18, either with or without weights 54 thereon, will provide a resistive force to rotational movement of a respective exercise arm 16 in either rotational direction.

For example, referring to FIG. 1, if the exercise arms 16 are engaged to locking members 20 and are both pushed downwardly, the weight supporting members 18 either with or without weights thereon will be rotated upwardly in the direction shown by arrow 56, and thereby provide a resistive force to the downward rotational movement of the exercise arms.

In the FIG. 2 arrangement of the exercise device 10, if the exercise arm 16 on the right, with its rotational axle 40 in a lower position is engaged to the locking member 20 and pulled upwardly, the weight supporting member 18, either with our without weights 54 thereon, will be rotated in the direction shown by arrow 58; thereby providing a resistive force to the upward rotation of the exercise arm.

Referring to FIG. 1, each of the exercise arms 16 preferably includes inner and outer telescopic sections 60, 62. The outer telescopic section 62 includes a pin 64 through a wall thereof, which normally is spring biased inwardly to engage within a desire opening or groove 66 in the inner telescopic section 60 to set the desired length of each exercise arm 16. The distal end of the inner telescopic section of each exercise arm 16 includes a handle 68 to be engaged by an individual conducting an exercise. The handle 68 can be of any desired construction and the specific construction is not a limitation on the broadest aspects of this invention. It obviously is desirable to provide a comfortable construction for engagement by an individual.

Referring to FIGS. 1 and 2, the manner of retaining the axles 40 in its uppermost position (arm assemblies 12 and 14 in FIG. 1 and arm assembly 12 in FIG. 2) and in its lowermost position (arm assembly 14 in FIG. 2) will be described. Each of the elongate sections 30, 32 of member 24 of each of the arm assemblies 12 and 14 includes ears 70, 72 extending outwardly from opposed sides thereof and each of said ears includes an opening 74 therethrough. When elongate member 24 is in the position shown in FIG. 1 to position the rotational axle 40 in its uppermost position, an opening 74 in ear 70 of elongate section 30 is axially aligned with an opening 74 in an ear 70 of the other elongate section 32 and also with one of the openings 29 extending through vertical frame member 26. A locking pin 76 is inserted through the aligned openings 74, 29 through the ears 70 and vertical frame member 26 to retain the elongate member 24 of arm assemblies 12 and 14 in the positions shown in FIG. 1. It should be noted that the ears 70 are provided to permit the openings 74 therein to be aligned with openings 29 that often are centrally located in, or easily formed in the center of a corresponding vertical frame member 26. Although the inclusion of the ears 70 is preferred, this is not a limitation on the broadest aspects of this invention. If ears 70 are not provided then aligned openings will need to be provided in the spaced-apart elongate sections 30, 32 of each elongate member 24, and a corresponding aligned opening will need to be provided in the corresponding vertical frame member 26.

Referring to arm assembly 14 in FIG. 2, when elongate member 24 is in the position shown therein to position and retain the rotational axle 40 in its lowermost position, opening 74 in the ear 72 of elongate section 30 is axially aligned with an opening 74 in an ear 72 of the other elongate section 32 and also with one of the openings 29 extending through vertical frame member 26. The locking pin 76 is inserted through the aligned openings 74 and 29 in the ears 72 and vertical frame member 26, respectively, to retain the elongate member 24 of arm assembly 14 in the position shown in FIG. 2. As noted earlier with respect to the provision of ears 70, likewise, although the provision of ears 72 is preferred, such a construction is not required in accordance with the broadest aspects of this invention.

Referring to FIGS. 5 and 6, further details of the exercise device 10 will be described. Axle 40 is rotatably mounted on bearings 78 retained in the annular member 38. The bearings 78 include passages 80 therethrough that are hexagonal in cross-section. The axle 40 includes a cylindrical section 82 at one end, joined to an elongate section 84 having a hexagonal cross-section. The locking member 20 includes a central hub 21 either formed as part of the locking member or secured thereto by any suitable means, e.g., bolting or welding. The central hub includes a passage 23 therethrough that is hexagonal in cross-section. A hexagonal passage 51 extends through a distal end of downwardly extending arm 50 of weight supporting member 18 opposed to the lower end thereof that includes the transverse extension 52 configured to receive one or more weights 54 thereon.

Referring to FIG. 5, in the operative condition of the arm assembly 12, the elongate section 84 of axle 40, which has a hexagonal cross-section, extends through the hexagonal passages 80 of bearings 78 within annular member 38, through the hexagonal passage 23 of the central hub 21 of the locking member 20 and through the hexagonal passage 51 in the downwardly extending arm 50 of the weight support member 18. As a result of this arrangement, when the exercise arm 16 is locked to the locking member 20 in a desired position, as described hereinafter, rotation of the exercise arm 16 rotates the locking member 20; the axle 40 through the connection of the elongate section 84 of the axle to the central hub 21 of the locking member, and the weight supporting member 18 through the connection of the elongate section 84 of the axle to the downwardly extending arm 50 of said weight supporting member. The axle 40 is freely rotatable within annular member 38 through bearings 78.

Figure 3:
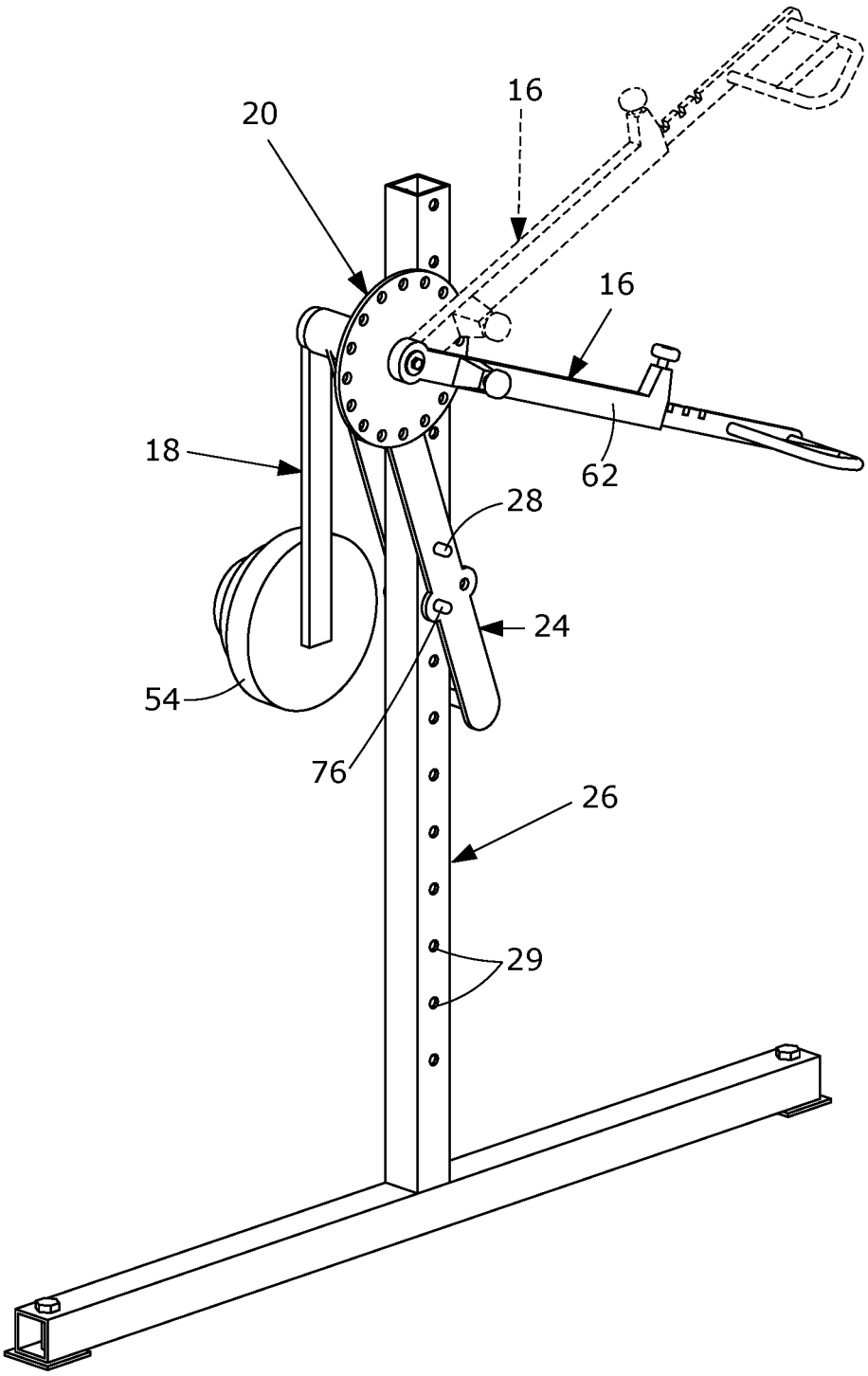
FIG. 3 is an inner isometric view of the right arm assembly 14 showing, in phantom, the exercise arm thereof in an alternate, fixed rotatable position.
Figure 4:
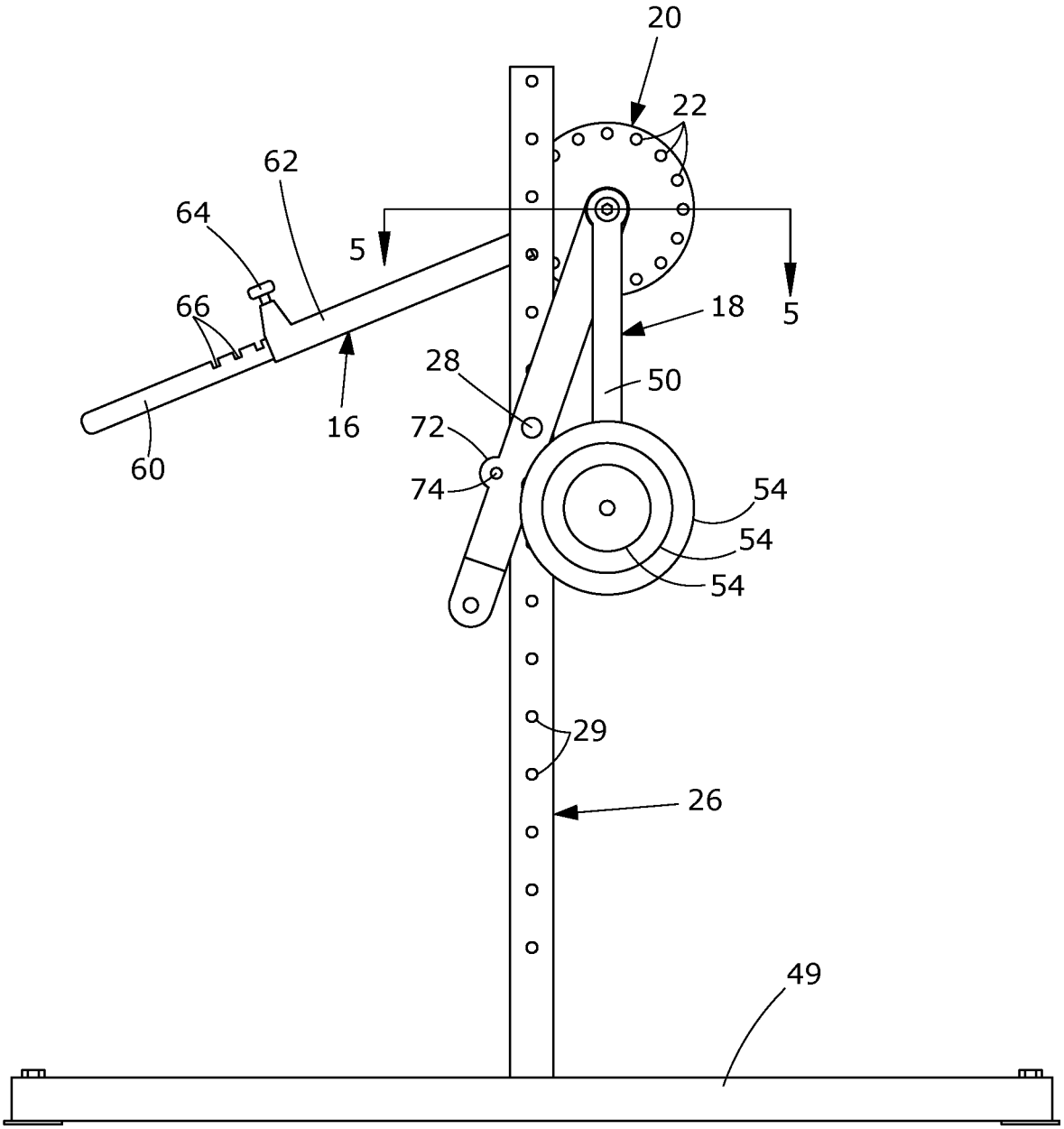
FIG. 4 is an outer, elevational view of the right arm assembly shown in FIG. 1.

Referring to FIGS. 5 and 6, the outer telescopic section 62 of each exercise arm 16 includes a cylindrical passage 86 received on the cylindrical section 82 of the axle 40 to be freely rotatable on said cylindrical section. The outer telescopic section 62 of the exercise arm 16 includes a connecting pin 88 extending within a passage of a hub 90 forming a part of the outer telescopic section, said pin 88 including a distal end 92 and preferably being spring biased inwardly to permit engagement of the distal end of said pin within a desired opening 22 in locking member 20. This arrangement permits rotatable adjustment of the exercise arm 16 into different operative positions depending upon the exercise to be conducted and/or the size of the individual exerciser. Two such positions are shown in solid and phantom representation, respectively, in FIG. 3.

Still referring to FIGS. 5 and 6, locking screws 94, 96 and associated washers 98, 100, respectively are employed to retain components of each of the exercise arm assemblies 12, 14 connected together. Specifically, the cylindrical section 82 at one end of axle 40 includes a threaded passage 102 therein. Locking screw 94 with its associated washer 98 thereon is secured within the threaded passage 102 to retain the exercise arm 16 on axle 40 with the distal end of central hub 21 of the locking member 20 in engagement with an adjacent bearing 78. In a similar manner, locking screw 96 with its associated washer 100 thereon is threaded into threaded passage 104 in the opposed end of axle 40 for retaining the weight supporting member 18 thereon, with an inner section of the downwardly extending arm 50 of the weight supporting member in engagement with an adjacent bearing 78.

Figure 7:
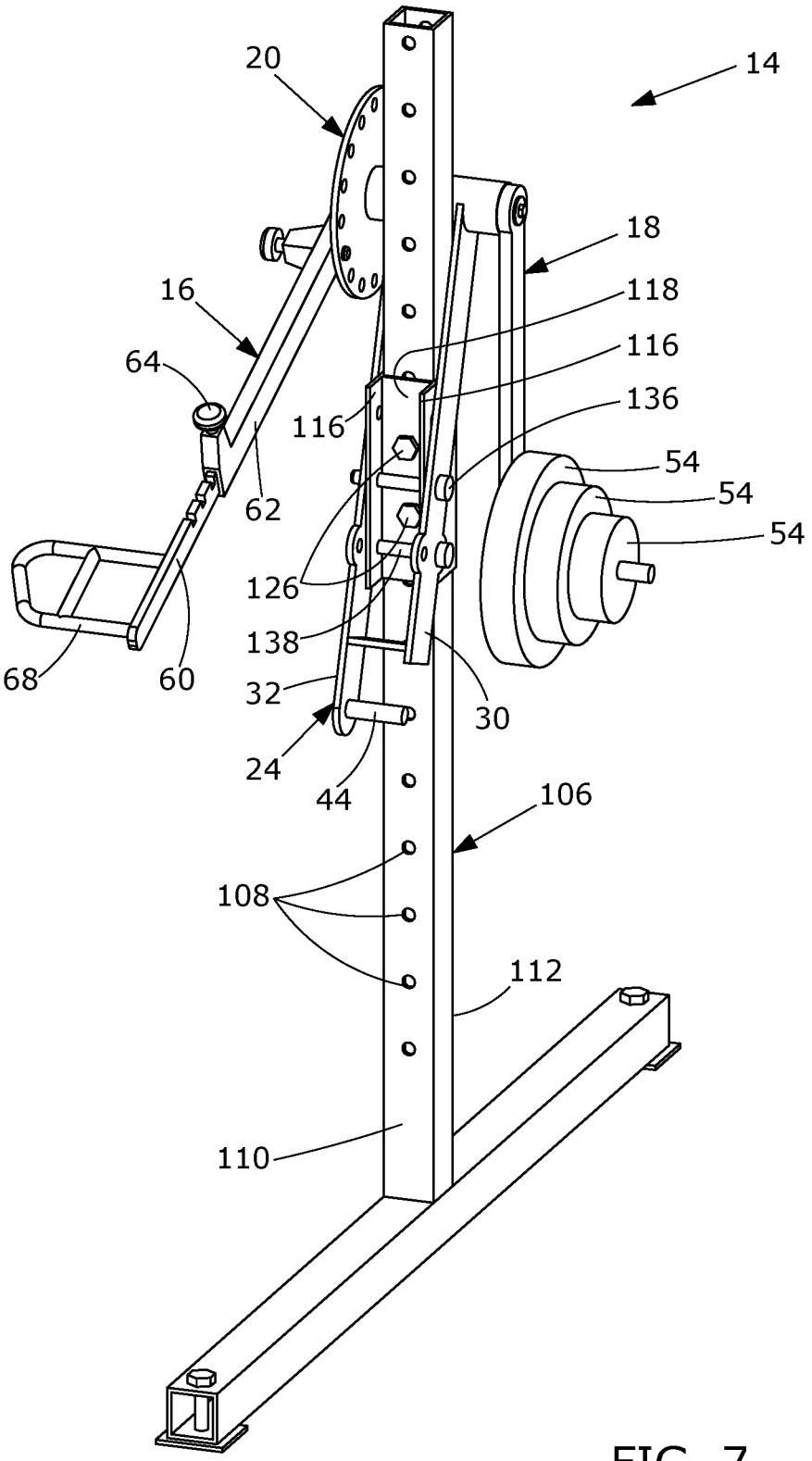
FIG. 7 is an isometric view showing an alternate arrangement for mounting the arm assemblies of this invention to a vertical frame member.
Figure 8:
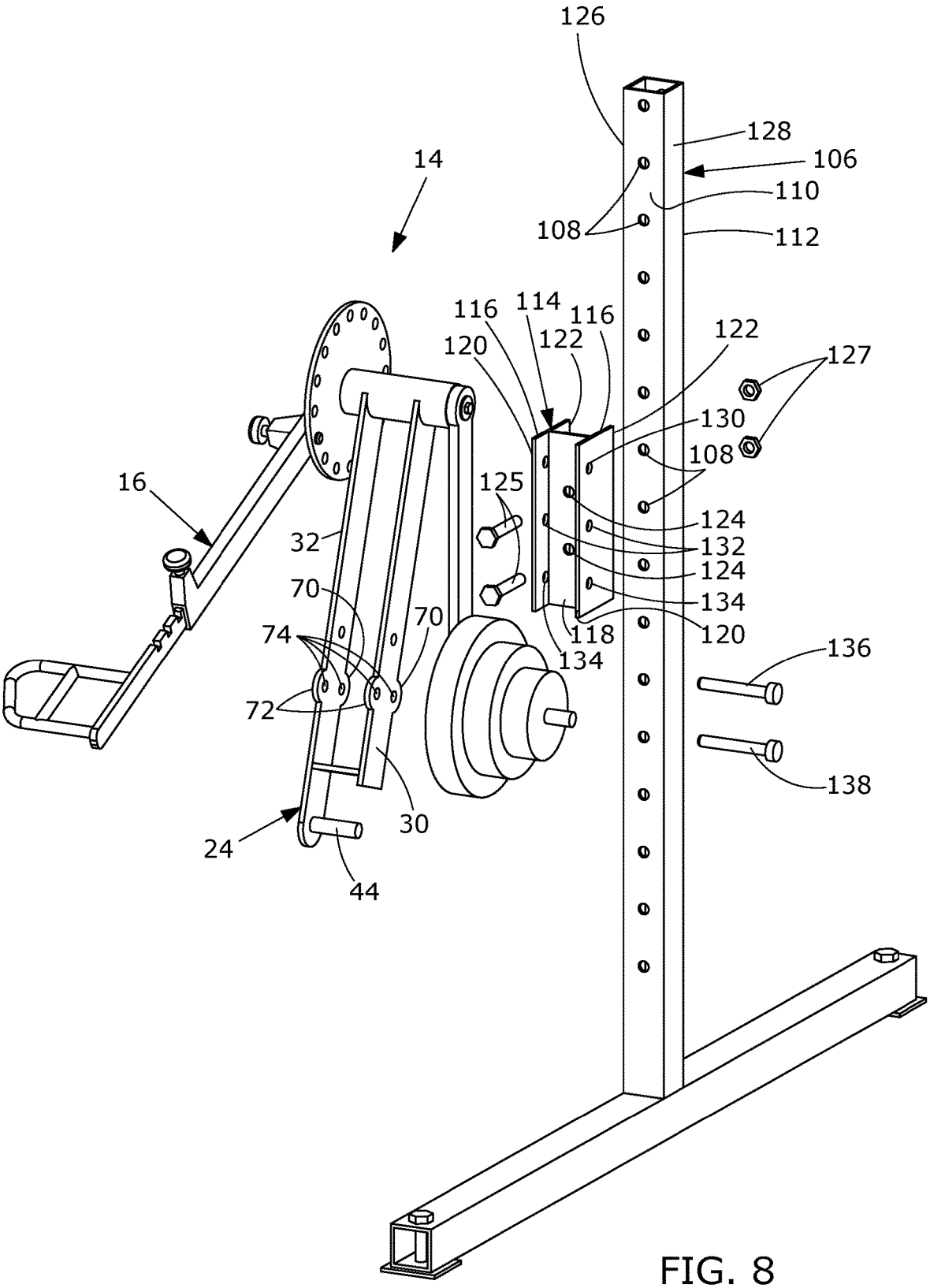
FIG. 8, shows elements of the FIG. 7 embodiment in an exploded isometric view.

Referring to FIGS. 7 and 8, an alternate arrangement for fastening the exercise arm assembly 14 to a vertical frame member 106 is shown; it being understood that this same alternative arrangement can be employed to attach a transversely spaced-apart exercise arm assembly 12 to a transversely spaced-apart vertical frame member 106. In this embodiment, the frame member 106 preferably is of a square cross section and includes vertically spaced-apart openings 108 in front and rear walls 110, 112 thereof. Only the spaced-apart openings 108 in front wall 110 are shown, it being understood that a corresponding set of axially aligned openings are included through the rear wall 112. A separate attachment member 114 is provided to mount the exercise arm assembly 14 in a desired vertical position on the vertical frame member 106.

As can be seen best in FIG. 8, the exercise arm assembly 14 is of the same construction as described earlier herein. The attachment member 114 preferably is a generally H-shaped, elongate member including vertically elongate, transversely spaced-apart side members 116 connected together by a vertically elongate central member 118 intermediate front and rear edges 120, 122 of each of said side members 116. The central member 118 includes spaced-apart openings 124 that are vertically spaced-apart a distance to align with a pair of vertically spaced-apart openings 108 in the front and rear walls 110, 112 of the vertical frame member 106. As shown, in FIG. 11, the spaced-apart openings 124 are spaced-apart from each other the same distance as adjacent openings 108 are spaced apart in the vertical frame member 106.

Referring to FIGS. 7 and 8, bolts 125 or other suitable fastening members are inserted through the spaced-apart openings 124 in central member 118 of the attachment member 114 and aligned openings 108 in the vertical frame member 106 to connect the attachment member 114 to the vertical frame member at a desired location. In a preferred embodiment, lock nuts 127 are threaded onto the bolts to provide a secure attachment. In this connected condition, sections of the side members 116 extending rearward of the central member 118 overlap and are closely adjacent to side walls 126, 128 of the vertical frame member 106 to provide a very stable connection. If openings are provided in the sidewalls 126, 128, axially aligned openings can be provided in side members 116 and bolts or other suitable fastening members can be provided to secure the side members 116 to the sidewalls of the vertical frame member. This can be in addition to, or as an alternative to connecting the central member 118 of the attachment member 114 to the vertical frame member 106.

Referring to FIG. 8, sections of the side members 116 extending forward of the central member 118 each include three vertically spaced apart openings 130, 132 and 134 therein. The vertically spaced apart opening 130, 132, 134 in each side wall being in axially alignment with the spaced-apart openings 130, 132, 134, respective in the other side wall.

Referring to FIGS. 7 and 8, an axle 136 extends through central opening 132 and can be of any desired construction for rotationally receiving one of said spaced-apart arm assembly 12, 14 thereon, in the same manner that such arm assemblies are connected to vertical frame members 26 in the earlier-described embodiments of this invention.

Specifically, the elongate sections 30, 32 of the elongate member 24 are rotatably mounted on axle 136 to permit the axle 40 and the members connected thereto to be positioned in their desired upper or lower position in the same manner as described earlier.

Still referring to FIGS. 7 and 8, the arm assembly 14 is shown with the axle 40 thereof (and components connected to said axle) retained in its uppermost position. Specifically, to retain the axle 40 in its uppermost position, a locking pin 138 extends through aligned openings 74, in the ears 70 of elongate sections 30, 32 and lower openings 134 in side members 116 of attachment member 114, respectively.

To position and retain the axle 40 and the connected components of arm assembly 12 in the lowermost position (e.g., the position of arm assembly 14 in FIG. 2) the arm assembly is rotated about axle 136 to a position in which the axially aligned openings 74 in ears 72 are axially aligned with upper openings 130 in the side members 116 of attachment member 114 and the locking pin 138 is inserted through said axially aligned openings.

Various modifications can be made in accordance with the broadest aspects of this invention. For example, the arrangement to rotatably connect the axle 40 to the locking member 20 and the downwardly extending arm 50 of the weight supporting member 18 so that they rotate as a unit need not be hexagonal. Forming the axle of other non-round cross-sectional shapes to engage similar non-round shaped passages in the locking member 20 and downwardly extending arm 50 can be employed. Or, as an alternative, a groove and key arrangement can be provided to rotatably connect together the axle 40 with locking member 20 and the axle 40 with the downwardly extending arm 50 of the weight supporting member. In the preferred embodiment a hexagonal, square or other multi-sided arrangement is employed to provide the rotational connection among the various elements described above.

In addition, in accordance with the broadest aspects of this invention the attachment member 114 disclosed in FIGS. 7 and 8 need not be H-shaped. Other configurations can be employed provided they include one or more sections to be connected to a vertical frame member, and transversely spaced-apart sections extending outwardly from a front wall of the vertical frame member and each including spaced-apart openings 130, 132 and 134 aligned with corresponding openings in the other of the transversely spaced-apart sections. For example, and not by way of limitation, the attachment member can be U-shaped, with the legs of the U-shaped member being closely adjacent to and secured to opposed side walls of a vertical frame member, respectively, said legs extending outwardly of a front wall of the vertical frame member and terminating in a connecting base of the U-shaped member. In this construction the openings corresponding to openings 130, 132 and 134 are included in the sections of the legs extending forwardly or outwardly of the front wall of the vertical frame member.

In addition, although specific, preferred arrangements are disclosed for providing rotational connections for the various components required to be rotationally mounted relative to each other, any operable rotational connection (e.g., bearings, bushings, etc.) can be employed in accordance with the broadest aspects of this invention.

Furthermore, in accordance with the broadest aspects of this invention any suitable arm construction can be employed. For example, although it is very desirable to employ a telescopic arrangement for the exercise arms 16, in accordance with the broadest aspects of this invention the arms need not be telescopic. Moreover, in accordance with the broadest aspects of this invention any desired handle construction can be employed, including more than one handle mounted on each of the exercise arms 16; the handles on each exercise arm being spaced axially along the length of each arm. Most preferably, when multiple handles are included on each exercise arm 16, the handles on each of the arms should be aligned with a corresponding handle on the other of said arms.

While the invention has been described in detail herein, it will be apparent to one skilled in the art that various changes and modifications can be made therein without departing from the spirit and scope thereof.

What is claimed is:

1. An exercise device including:

an exercise arm connected to a weight supporting member to rotate relative to said weight supporting member when unlocked, a locking member to which said exercise arm is configured to be locked in multiple rotational positions, said locking member being connected to said weight supporting member to rotate with said weight supporting member, said exercise arm rotating said weight supporting member when locked to said locking member and being rotated during exercising, an elongate member rotationally retained on a frame member at a location intermediate first and second opposed ends of said elongate member, said exercise arm, weight supporting member and locking member having a connection to said elongate member adjacent one of said first and second opposed ends for rotational motion when said exercise arm is locked to said locking member and rotated during exercising, said elongate member being engageable by an individual to rotate said elongate member for providing vertical adjustment of the exercise arm, weight supporting member and locking member, and retention means for retaining the elongate member in a first rotational position in which the connection of the exercise arm, weight supporting member and locking member to said elongate member is vertically above the location at which the elongate member is rotationally retained on said frame member, and in a second rotational position in which the connection of the exercise arm, weight supporting member and locking member to said elongate member is vertically below the location at which the elongate member is rotationally retained on said frame member.

2. The exercise device of claim 1, further including an elongate, horizontal member rotatably mounted in said elongate member adjacent one of said first and second opposed ends, said locking member and weight supporting member being fixedly connected to said elongate, horizontal member to rotate with said elongate, horizontal member, and said exercise arm being rotatably mounted on and relative to said horizontal member when unlocked and being rotatable with said horizontal member when locked to said locking member in a desired position.

3. The exercise device of claim 1, further including an elongate, horizontal member rotatably mounted in said elongate member adjacent one of said first and second opposed ends, said locking member and weight supporting member being fixedly connected to said elongate, horizontal member to rotate with said elongate, horizontal member, and said exercise arm being rotatably mounted on and relative to said horizontal member when unlocked and being rotatable with said horizontal member when locked to said locking member in a desired position, said weight supporting member including a first elongate section extending downwardly from said elongate, horizontal member and including a second section in the form of an extension from said first elongate section, said extension being configured to removably retain one or more free-weights thereon.

4. The exercise device of claim 1, further including an elongate, horizontal member rotatably mounted in said elongate member adjacent one of said first and second opposed ends, said locking member and weight supporting member being fixedly connected to said elongate, horizontal member to rotate with said elongate, horizontal member, and said exercise arm being rotatably mounted on and relative to said horizontal member when unlocked and being rotatable with said horizontal member when locked to said locking member in a desired position, said weight supporting member including a first elongate section extending downwardly from said elongate, horizontal member and terminating at a distal end spaced from said elongate, horizontal member, and including a second section in the form of an extension from said first elongate section adjacent the distal end of said first elongate section, said extension being configured to removably retain one or more free-weights thereon.

5. The exercise device of claim 1, further including an attachment member configured to be fixed to said frame member in a desired vertical position, said elongate member being rotationally retained on said frame member through said attachment member.

6. The exercise device of claim 1, further including an attachment member configured to be fixed to said frame member in a desired vertical position, said elongate member being rotationally retained on said frame member through said attachment member, wherein said frame member is part of a conventional cage employed for mounting exercise equipment.

7. The exercise device of claim 1 being free of pulleys.

8. An exercise device including:

an elongate support member including first and second opposed ends and being rotatably mounted through a rotatable mount to a mounting member intermediate said first and second opposed ends, a horizontally extending axle rotatably mounted to said elongate support member adjacent one of said first and second opposed ends, said horizontally extending axle being connected to a weight support on one side of the rotatably mounted elongate support member and being connected to an exercise arm on an opposite side of said rotatably mounted elongate support member, said elongate support member being grippable for rotating said elongate support member about said rotatable mount to change the vertical position of said horizontally extending axle and said weight support and exercise arm connected thereto.

9. The exercise device of claim 8, further including a first locking member connected to said horizontally extending axle adjacent said exercise arm, said first locking member being connected to said horizontally extending axle to rotate therewith, said exercise arm having a second locking member configured to be engaged and disengaged from said first locking member at various rotational positions relative to said horizontally extending axle, said exercise arm being rotatable about and relative to said horizontally extending axle when said second locking member is disengaged from said first locking member to position the exercise arm in a desired orientation for engagement by an individual during exercising, said exercise arm being engageable by said individual to rotate the horizontally extending axle and weight support connected thereto when said first and second locking members are engaged.

10. The exercise device of claim 8 being free of pulleys.

11. The exercise device of claim 8, said elongate support member having a gripping section spaced from the rotatable mount on an end of said rotatable mount opposite the end of said rotatable mount to which the horizontally extending axle is mounted.

12. The exercise device of claim 8, further including a first locking member connected to said horizontally extending axle adjacent said exercise arm, said first locking member being connected to said horizontally extending axle to rotate therewith and including a plurality of arcuately spaced-apart openings therein, said exercise arm having a second locking member configured to be engaged in and disengaged from said arcuately spaced openings of said first locking member, said exercise arm being rotatable about and relative to said horizontally extending axle when said second locking member is disengaged from said first locking member to position the exercise arm in a desired orientation for gripping by an individual during exercising, said exercise arm being engageable by said individual to rotate the horizontally extending axle and weight support connected thereto when said second locking member is engaged within one of said arcuately spaced openings of said first locking member.

13. The exercise device of claim 8, said mounting member being an elongate frame member including multiple openings for use in connecting exercise devices thereto.

14. The exercise device of claim 8, said mounting member being an elongate frame member of a conventional cage for supporting an exercise device.

15. The exercise device of claim 8, further including an attachment member configured to be fixed to said mounting member in a desired position, said elongate member being rotationally retained on said mounting member through said attachment member.

16. The exercise device of claim 8, further including an attachment member configured to be fixed to said mounting member in a desired position, said elongate member being rotationally retained on said mounting member through said attachment member, wherein said mounting member is a frame member of a conventional cage employed for mounting exercise equipment thereto.

17. An attachment member configured to be fixed to a mounting member in a desired position for retaining an exercise device on said mounting member through said attachment member, said attachment member including two side walls, said two side walls being spaced-apart and each of said two side walls including a side wall sections extending outwardly of said mounting member, each of said two side wall sections including an opening therein aligned with a corresponding opening in the other of said two side wall sections, thereby providing a set of aligned openings unobstructed by said mounting member, said exercise device including an elongate support member including first and second opposed ends and being rotatably mounted intermediate said first and second opposed ends through a rotatable mount retained in said set of aligned openings in said two side wall sections of the attachment member, said exercise device further including a horizontally extending axle rotatably mounted to said elongate support member adjacent one of said first and second opposed ends, said horizontally extending axle being connected to a weight support and to an exercise arm, said elongate support member being grippable for rotating said elongate support member about said rotatable mount to move said horizontally extending axle and said weight support and exercise arm connected to said horizontally extending axle into different positions.

18. The attachment member of claim 17, wherein each side wall section includes three openings, each of said three openings in each side wall section being axially aligned with a corresponding one of said three openings in the other of said side wall sections to provide three sets of aligned openings unobstructed by said mounting member, said elongate support member being rotatably mounted through a rotatable mount intermediate said first and second opposed ends through said rotatable mount, said rotatable mount being retained in one of said three sets of aligned openings in said side wall sections of the attachment member, said horizontally extending axle being connected to said weight support on one side of said rotatably mounted elongate support member and being connected to said exercise arm on an opposite side of said rotatable mount, further including a retention member engageable within a second of said three sets of aligned openings in the side wall sections of the attachment member for retaining the horizontally extending axle and said weight support and exercise arm connected to said horizontally extending axle in a vertical position above said vertical mount, and said retention member being engageable within a third of said three sets of aligned openings in the side wall sections of the attachment member for retaining the horizontally extending axle and said weight support and exercise arm connected to said horizontally extending axle in a vertical position below said vertical mount.

* * * * *